US010533267B2

(12) United States Patent
Haska et al.

(10) Patent No.: US 10,533,267 B2
(45) Date of Patent: Jan. 14, 2020

(54) TEXTILE MACHINE FOR THE PRODUCTION OF ROVING AND METHOD FOR OPERATING THE SAME

(71) Applicant: Maschinenfabrik Rieter AG, Winterthur (CH)

(72) Inventors: Petr Haska, Ceska Trebova (CZ); Jiri Stech, Utsi nad Orlici (CZ); Robert Mikyska, Dolni Dobrouc (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 566 days.

(21) Appl. No.: 15/309,451

(22) PCT Filed: Apr. 17, 2015

(86) PCT No.: PCT/IB2015/000519
§ 371 (c)(1),
(2) Date: Nov. 8, 2016

(87) PCT Pub. No.: WO2015/170157
PCT Pub. Date: Nov. 12, 2015

(65) Prior Publication Data

US 2017/0152124 A1 Jun. 1, 2017

(30) Foreign Application Priority Data

May 8, 2014 (CH) ..... 698/14

(51) Int. Cl.
*D01H 5/72* (2006.01)
*D01H 7/92* (2006.01)
(Continued)

(52) U.S. Cl.
CPC ..... *D01H 5/72* (2013.01); *B65H 54/02* (2013.01); *B65H 57/006* (2013.01); *D01H 7/92* (2013.01); *B65H 2701/31* (2013.01)

(58) Field of Classification Search
CPC ... D01H 5/72; D01H 7/92; D01H 9/14; B65H 54/02; B65H 57/006
See application file for complete search history.

(56) References Cited

U.S. PATENT DOCUMENTS 252,018 A * 1/1882 Colahan ..... B65H 9/10 242/154
1,596,095 A * 8/1926 Gehman ..... B65H 59/30 242/154
(Continued)

FOREIGN PATENT DOCUMENTS

DE 24 47 715 4/1976
DE 32 37 989 C2 7/1983
(Continued)

OTHER PUBLICATIONS

PCT Search Report, dated Sep. 17, 2015.
Swiss Search Report, dated Oct. 10, 2014.

*Primary Examiner* — Shaun R Hurley
(74) *Attorney, Agent, or Firm* — Dority & Manning, P.A.

(57) ABSTRACT

A method for operating a textile machine is provided to produce roving from a fiber bundle with a consolidating means, the roving having a protective twist. The produced roving is wound onto a tube with a winding device. During the winding process, the roving is guided a guide element arranged between the consolidating means and the tube, wherein the guide element exerts a decelerating effect on the roving. The decelerating effect is controlled during operation of the textile machine such that the decelerating effect is lower during a start procedure while the roving leaving the consolidating means is brought into contact with a tube or during a tube change while a wound tube is replaced by an empty tube than during a winding process that takes place between the start procedure and the tube change.

15 Claims, 10 Drawing Sheets

(51) Int. Cl.
*B65H 57/00* (2006.01)
*B65H 54/02* (2006.01)

(56) References Cited

U.S. PATENT DOCUMENTS 1,997,709 A * 4/1935 Williams ..... B65H 59/14 242/154
2,091,153 A * 8/1937 Martin ..... D01H 5/72 19/157
3,735,575 A * 5/1973 Hattori ..... D01H 1/00 57/331
4,023,342 A 5/1977 Schenkel
4,028,874 A 6/1977 Maag et al.
4,726,180 A * 2/1988 Naylor ..... D02G 1/06 57/284
4,819,457 A * 4/1989 Wurst ..... B65H 57/02 242/147 R
9,676,588 B2 * 6/2017 Haska ..... D01H 1/36
2002/0059701 A1 * 5/2002 Tsuzuki ..... D01H 5/72 19/258
2002/0104195 A1 * 8/2002 Tsuzuki ..... D01H 5/72 19/65 R
2005/0273980 A1 * 12/2005 Schlichter ..... D01G 15/46 19/150
2009/0289141 A1 11/2009 Griesshammer
2014/0117142 A1 * 5/2014 Haska ..... D01H 1/36 242/476.7
2014/0284415 A1 9/2014 Griesshammer

FOREIGN PATENT DOCUMENTS

DE 195 27 339 C1 10/1996
DE 2 463 414 A2 6/2012
EP 0 375 242 A2 6/1990
WO WO 2009/086646 A1 7/2009
WO WO 2013/000097 A1 1/2013
WO WO 2013/010280 A1 1/2013

* cited by examiner

TEXTILE MACHINE FOR THE PRODUCTION OF ROVING AND METHOD FOR OPERATING THE SAME

FIELD OF THE INVENTION

The present invention relates to a method for operating a textile machine which serves to produce roving, wherein during roving production a roving having a protective twist is produced by means of at least one consolidating means from a fiber bundle that is fed to the consolidating means. The roving produced by the consolidating means is wound by a winding device onto a tube, wherein the roving during the winding process is guided by means of a guide element arranged between the consolidating means and the tube. The guide element exerts a decelerating effect on the roving. A textile machine for producing a roving is also proposed, wherein the textile machine has at least one consolidating means by which a protective twist can be given to a fiber bundle that is fed to the consolidating means. The textile machine has at least one winding device, by means of which the roving can be wound onto a tube.

BACKGROUND

Roving is produced from slivers which are usually pretreated (for example doubled) by drafting and serves as a precursor for the subsequent spinning process, in which the individual fibers of the roving are spun, for example by means of a ring spinning machine, to form a yarn. In order to give the roving the strength necessary for the further processing, it has proven to be advantageous, during production of the roving, to draft the supplied fiber bundle by means of a drafting system, which is usually part of the preliminary spinning machine in question, and then to provide it with a protective twist. The strength is important in order to prevent tearing of the roving during the winding onto a tube and/or during the feeding thereof to the downstream spinning machine. The protective twist that is given must on the one hand be sufficient to ensure that the individual fibers hold together during the individual winding and unwinding processes and corresponding transport processes between the respective types of machine. On the other hand it must also be ensured that, despite the protective twist, the roving can be further processed in a spinning machine—the roving must therefore still be able to be drafted.

For producing such a roving, use is primarily made of so-called flyers, the delivery speed of which is nevertheless limited due to centrifugal forces that occur. There have therefore already been many proposals for circumventing the flyers or replacing them with an alternative type of machine (see for example EP 0 375 242 A2, DE 32 37 989 C2).

In this connection, it has also already been proposed, inter alia, to produce roving by means of air-jet spinning machines, in which the protective twist is created by means of swirled air flows. The basic principle here consists in guiding a fiber bundle through a consolidating means designed as an air spinning nozzle, in which an air vortex is generated. This ultimately brings about the situation whereby some of the outer fibers of the supplied fiber bundle are wrapped as so-called wrapping fibers around the centrally running fiber strand, which in turn consists of core fibers running substantially parallel to one another.

Another method for roving production is disclosed in DE 24 47 715 A1. The consolidation of the unconsolidated fiber bundle described therein takes place by a consolidating means which brings about not a twisting, but rather a helical wrapping of a sliver with one or more filament yarns, preferably monofilament yarns, which hold the fiber bundle together and give it its strength. The spirals of the individual filament yarns may in this case be arranged in the same direction or in opposite directions. Preference is given to two filament yarns which are arranged in opposite directions of rotation and in a manner crossing over one another. The roving produced in this way is thus composed essentially of a sliver of parallel staple fibers and one or more fine-titer filament yarns wrapping helically around the sliver.

There are various possibilities for wrapping the filament yarn or filament yarns around the unconsolidated fiber bundle. For example, the filament yarn can be applied onto small bobbins of small diameter. The filament yarn is then drawn off from the stationary bobbin and drawn through the bobbin axis together with the fiber bundle, whereby the filament yarn is wrapped around the fiber bundle and the number of windings drawn off from the bobbin corresponds to the number of wraparounds applied to the fiber bundle. In principle, it is also possible to design the consolidating means in such a way that only the unconsolidated fiber bundle is guided through the bobbin axis, so as consequently to relocate the winding process to behind the filament yarn bobbin. The wrapping point should in this case be defined by a suitable thread guide.

Another method for producing roving is described in WO 2009/086646 A1, wherein the method comprises the following steps: 1) providing a fiber bundle in the form of two, preferably untwisted, slivers, 2) applying S and Z twists over alternating regions of the two slivers, wherein regions of S and Z twists on the respective sliver are separated by regions without any twist, and 3) bringing together the two slivers provided with S and Z twists to form a roving, wherein the two slivers automatically twist together on account of their tendency to twist back.

The S and Z twists may be created for example by means of two elements of the consolidating means used, which hold the respective sliver in a clamped manner, wherein at least one element, preferably both elements, apply opposite twists on the sliver in an alternating manner on both sides by a relative movement on the surface thereof transversely to the longitudinal direction of the sliver. At the same time, the respective sliver is moved in the sliver direction. However, the S and Z twists can also be created by means of an aerodynamic, in particular pneumatic, method.

The alternating S and Z twists are moreover interrupted by intermediate regions without any twist. The two slivers provided with S and Z twists in the same way are finally brought together at the so-called joining point. Here, the slivers start to twist together automatically, that is to say, they wind around each other. This so-called double-folding maintains the S and Z twists in the individual slivers, so that a self-stabilizing two-component roving is obtained. In principle, however, care should be taken here to ensure that the regions without any twist in the first sliver should be arranged offset in the longitudinal direction relative to the regions without any twist in the second sliver, so that two regions without any twist in the first and second sliver never lie next to one another in the resulting roving, since the strength of the roving depends substantially on the phase position of the regions without any twist in the two slivers. As described above, the rovings are therefore always brought together by the consolidating means in such a way that their regions without any twist lie out of phase. The roving produced in this way ultimately has a greater strength than an untwisted fiber bundle, the strength ultimately being sufficient to wind the roving onto a bobbin and unwind it again from the latter without false drafts.

In any case, it has proven to be advantageous to guide the roving leaving the textile machine by means of a traversing arm which moves back and forth in a traversing manner parallel to the rotation axis of the tube that is to be wound, in order to give the finished bobbin (tube with roving wound thereon) the desired shape. Moreover, the traversing movement ensures that the roving is wound on in individual layers one on top of the other, so as subsequently to be able to unwind it again from the bobbin without there being any fear of tearing of the roving.

In order to achieve the desired bobbin structure, however, it is necessary during the winding process to subject the roving to a certain tension, since otherwise undesired loops might form on the bobbin surface, wherein the subsequent unwinding process would in this case be adversely affected.

SUMMARY OF THE INVENTION

It is therefore an object of the invention to adjust the tensile force acting on the roving in such a way that a reliable winding without loop formation is achieved, wherein it should also be ensured that the roving does not tear during the winding process as a result of the tensile force acting on the roving. Additional objects and advantages of the invention will be set forth in part in the following description, or may be obvious from the description, or may be learned through practice of the invention.

The objects are achieved by a method and a textile machine having the features described herein.

According to the invention, the roving is now guided during the process of being wound onto a tube by means of a guide element arranged between the consolidating means and the tube, wherein the guide element exerts a decelerating effect on the roving, the decelerating effect generated by friction between the roving and the guide element (the decelerating effect is generally necessary in order to gradually reduce the tensile force exerted on the roving by the rotating tube and thus to prevent any tearing of the roving between the tube and the consolidating means or between the tube and the draw-off unit).

It is also provided that the decelerating effect is adapted during operation of the textile machine in such a way that it is lower during a start procedure, while the roving leaving the consolidating means is being brought into contact with a tube, preferably an empty tube, and/or during a tube change, while a wound tube is being replaced by an empty tube, than during a normal operation that takes place between the start procedure and the tube change, during which normal operation the roving is wound onto the tube until a given degree of filling is reached.

If the roving during normal operation (that is to say during the winding process that takes place between the start procedure and the tube change) is decelerated in a relatively pronounced manner by the guide element, a correspondingly high tensile force is necessary in order to draw the roving over a corresponding guide surface of the guide element and finally to wind it onto the bobbin. The roving can therefore be wound suitably tightly onto the tube, resulting in a compact bobbin structure. The necessary tensile force is in this case transmitted to the roving preferably by the rotating tube, wherein the tube should be equipped with a suitably dimensioned tube drive. As a result, the considerable decelerating effect during the winding process thus ensures that the roving can be wound onto the tube under tension after it leaves the consolidating means.

On the other hand, during the start procedure and tube change procedure, only a limited tensile force can be transmitted to the roving since the latter is not yet grasped by the tube at this stage. Particularly when the roving produced by the consolidating means is sucked up by a suction unit during the start procedure or during a tube change, the tensile force acting on the roving is limited since the force is generated only by the air flow generated by the suction unit (which air flow sucks the roving into the suction unit). If at this stage the decelerating effect of the guide element is not reduced in comparison to normal operation, the tensile force generated by the suction unit would not be sufficient to suck in the roving counter to the decelerating effect of the guide element. The roving produced by the consolidating means would in this case also not be able to be forwarded to the tube, so that said normal operation would not be achieved at all.

Due to the inventive adaptation of the decelerating effect, therefore, it is possible to draw the roving over the guide surface of the guide element with a relatively low tensile force during the start procedure and tube change procedure, so that for, example, a suction unit that is acted upon by negative pressure can be used for this. At the same time, the tensile force acting on the roving can be increased after the end of the respective start procedure or tube change procedure by increasing the decelerating effect of the guide element, so that the roving can be wound onto the tube with the desired tension.

At this point, it should be pointed out in general (and thus also in connection with the textile machine according to the invention which will be described in more detail below) that the consolidating means may be designed in various ways. For example, it would be conceivable that the consolidating means is suitable for producing the roving in the manner described in the abovementioned documents WO 2009/086646 A1 and DE 24 47 715 A1.

Preferably, however, the textile machine is designed as an air-jet spinning machine and the consolidating means is designed as an air spinning nozzle, by means of which the protective twist in the roving is created, as described above, by means of swirled air flows (part of such a textile machine designed as an air-jet spinning machine is described by way of example in the description of the figures).

In any case, it is advantageous if the decelerating effect is varied by decreasing or increasing the size of the contact area over which the roving is in contact with the guide element. The contact area should in this case differ at least partially from a flat surface and should, for example, be curved or bent, since increasing the size of the contact area in the case of a flat surface would not lead to an increase in the friction between the contact area and the roving and thus would also not lead to an increase in the decelerating effect. The guide element should moreover have routing sections which guide the roving in such a way that it passes the guide element on a predefined path. The routing element or elements may comprise for example bumps and/or depressions which suitably guide the roving.

It is also advantageous if the roving is wrapped around the guide element over a wrapping angle, wherein the decelerating effect is varied by varying the wrapping angle. To this end, the guide element preferably has a guide surface which is formed by a surface section of a guide rod that is for example round or oval in cross section. Moreover, the roving may be wrapped around the guide element less than or even more than once both during a start procedure or tube change procedure and during normal operation of the textile machine. The extent of the decelerating effect is ultimately directly related to the number of wraparounds, wherein the number of course need not be a whole number. The winding direction also need not be consistent. For example, it would be possible that the roving wraps around the guide element in a first winding direction in a first area, while an opposite winding direction exists in the remaining area. The decelerating effect obtained as a result of the friction between the roving and the guide element can ultimately be influenced by winding the roving onto the guide element or unwinding it therefrom, wherein winding leads to an increase in the decelerating effect and vice versa. The winding and unwinding may take place by rotating the guide element or individual sections thereof, wherein the guide element may comprise a gripper which guides the roving, wherein only the gripper has to be rotated about a rotation axis in order to bring about the desired change in the wrapping angle.

It is also extremely advantageous if the wrapping angle during the winding process is at least temporarily between 400° and 2000°, preferably between 500° and 1800°, particularly preferably between 600° and 1600°. In this connection, it should in general be pointed out that a magnitude of more than 360° means that the roving is wrapped around the guide element more than just once. For example, a wrapping angle of 540° is to be equated to 1.5 wraparounds, a wrapping angle of 720° means two wraparounds, etc. If the value is between the magnitudes mentioned above, then it is ensured that the roving has to be drawn over the guide surface of the guide element with a relatively high tensile force and thus is subjected to a relatively high tension prior to being wound onto the tube. As a result, the desired compact bobbin with the tightly adjacent roving layers is obtained.

Advantages are also obtained if the wrapping angle during the start procedure and/or the tube change is at least temporarily between 50° and 1000°, preferably between 75° and 720°, particularly preferably between 100° and 500°. The decelerating effect is in this case relatively low in comparison to normal operation, so that the roving (which at least at the beginning of the start procedure and/or of a tube change is not in contact with the tube and thus also cannot be drawn over the guide surface of the guide element by the tube) can be moved by means of an air flow. The air flow is preferably generated by a suction unit which sucks up the roving produced by the consolidating means until said roving is grasped by the tube and is wound onto said tube as a result of the rotation thereof.

It is also advantageous if, on account of the decelerating effect, a tension acts on the section of the roving that is in contact with the guide element, wherein the decelerating effect is adapted such that the average magnitude of the tension during the winding process is at least two times, preferably at least four times, particularly preferably at least eight times, higher than during the start procedure and/or during the tube change. If the magnitude lies in the range, the roving can be drawn over the guide surface with only a low tensile force during the start procedure or tube change procedure, wherein the higher decelerating effect during normal operation ensures that the tensile force must be suitably high, resulting in a tight winding of the roving.

Advantages are moreover obtained if the increase in the decelerating effect is increased at the latest 10 seconds, preferably at the latest 6 seconds, particularly preferably at the latest 4 seconds, after the roving during the start procedure or during the tube change has come into contact with an empty tube provided by the winding device. After this time, the tube has already been wrapped around multiple times by the roving, so that during the further winding the necessary tensile force can already be transmitted to the roving in order to be able to draw the latter over the guide surface of the guide element despite the increased decelerating effect. The decelerating effect may in this case be increased abruptly or else gradually, for example by increasing the wrapping angle of the roving in the region of the guide element. During normal operation, the decelerating effect should ultimately remain constant, wherein of course changes are also not ruled out.

Furthermore, it is advantageous if the decelerating effect is increased while a first to 600th winding, preferably while a first to 300th winding, particularly preferably while a first to 100th winding, of the roving is being wound onto an empty tube. In contrast to the variant described in the previous paragraph, the decelerating effect in this case is not increased as a function of time but rather as a function of the number of windings. The number can be determined by means of a suitable sensor, which determines the number, for example, from the rotational speed of the tube.

It is also advantageous if the decelerating effect is reduced during the winding process at least 0.01 seconds, preferably at least 0.5 seconds, particularly preferably at least 1 second, and/or at most 20 seconds, preferably at most 10 seconds, particularly preferably at most 5 seconds, prior to the start of a pending tube change. It would also be possible to reduce the decelerating effect only once the tube change procedure starts, that is to say when a wound tube is being removed from the region in which it has been wound. However, if the tube is moved away from the guide element during the tube change, for example is rotated away by means of a rotating tube change device, then the tensile force exerted on the roving by the rotating tube is added to the tensile force exerted on the roving as a result of the tube being moved away, so that a tearing of the roving would occur if the decelerating effect was maintained.

The roving is thus wound relatively tightly onto the tube, so that the volume of the finished bobbin is relatively low in comparison to the wound quantity of roving. The roving wound onto the tube at the start of a winding process thus has a lower tension than the roving wound on after the end of the start procedure and/or the tube change. In return, however, the risk of the roving tearing in said sections outside of normal operation is considerably minimized.

Advantages are also obtained if the roving, at least during the winding process, is traversed between defined turning points by the guide element in order to be able to wind the roving onto the tube in multiple layers. The traversing in this case takes place preferably in a direction running parallel to the rotation axis of the tube.

It is also advantageous if the production of the roving is not interrupted during the tube change, wherein during the tube change the roving produced by the consolidating means is wound onto the tube that was wound prior to the tube change at least until the roving enters into contact with an empty tube as a result of the tube change. The changing of the tubes may take place for example by means of a rotating carrier which has at least two tube spaces. Once one of the tubes is sufficiently wound with roving, the carrier is rotated until the full tube located on the first tube space has moved outside of the region in which it was wound with roving. As a result, an empty tube (which is located on the second tube space) ultimately enters the region and can be wound with roving, without a separate start procedure being necessary for this.

It is particularly advantageous if the roving is guided continuously by the guide element during the tube change. In this case, the roving is continuously decelerated between the consolidating means and the tube, so that it can be wound onto the respective tube under a certain tension. The tension can once again be varied according to the above description, so that the decelerating effect can in each case be adapted to the current status of the winding process.

Finally, the textile machine according to the invention is characterized in that it has a controller designed to operate the textile machine according to one or more of the aspects described above or yet to be described below. It also comprises a guide element which is placed between the consolidating means of the textile machine and a winding device and which is designed to decelerate the roving as it passes the guide element. To this end, the guide element preferably comprises an elongate guide section, around which the roving can be wrapped. A gripper should also be present, by means of which the number of wraparounds can be influenced. For example, the gripper could be rotatable about a rotation axle and could comprise a gripping section in order to be able to grip the roving and wind it around the guide section as the gripper rotates.

BRIEF DESCRIPTION OF THE DRAWINGS

Further advantages of the invention are described in the following exemplary embodiments, in which.

DETAILED DESCRIPTION

Figure 1:
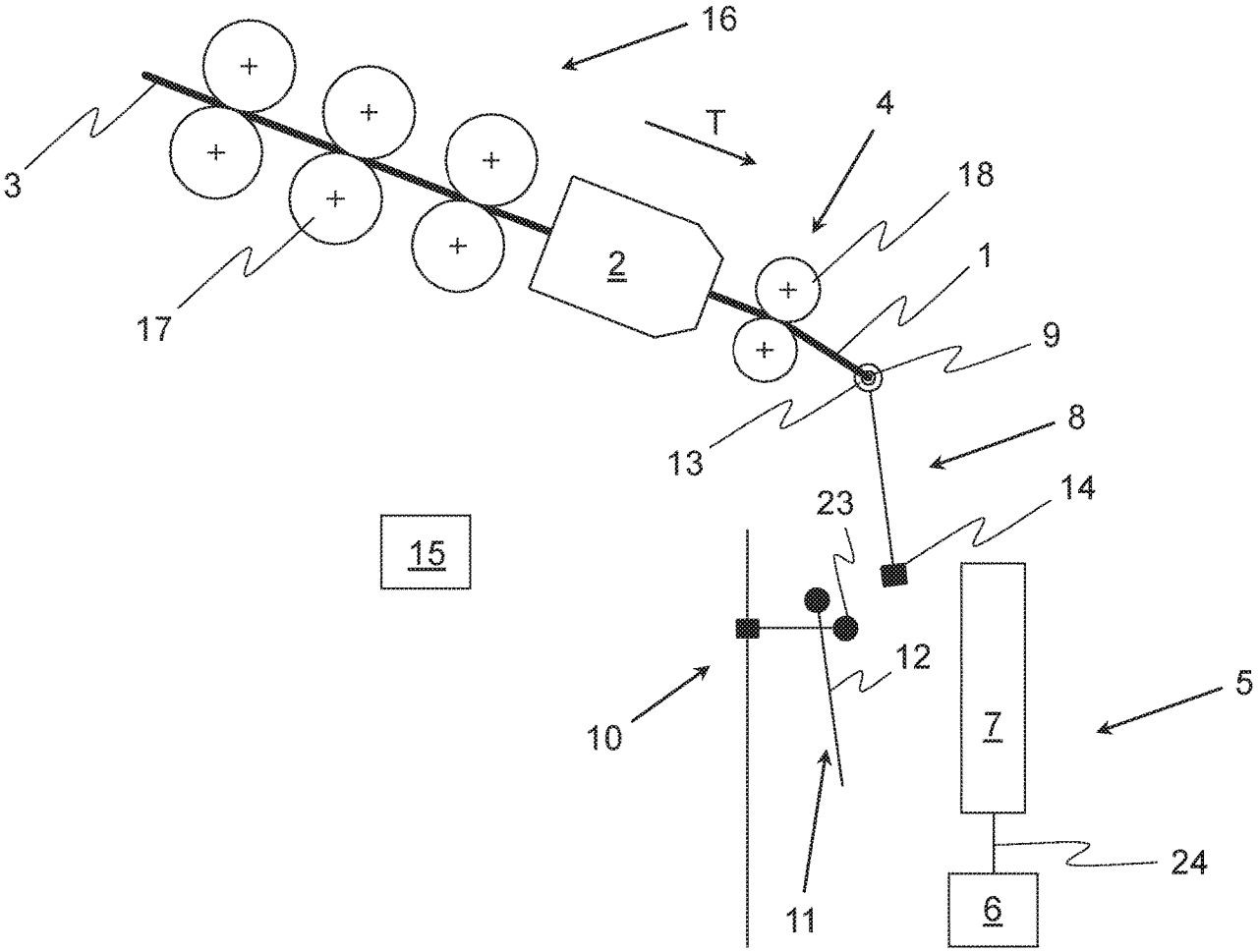
FIGS. 1 to 3 show part of a start procedure on a textile machine in the form of an air-jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
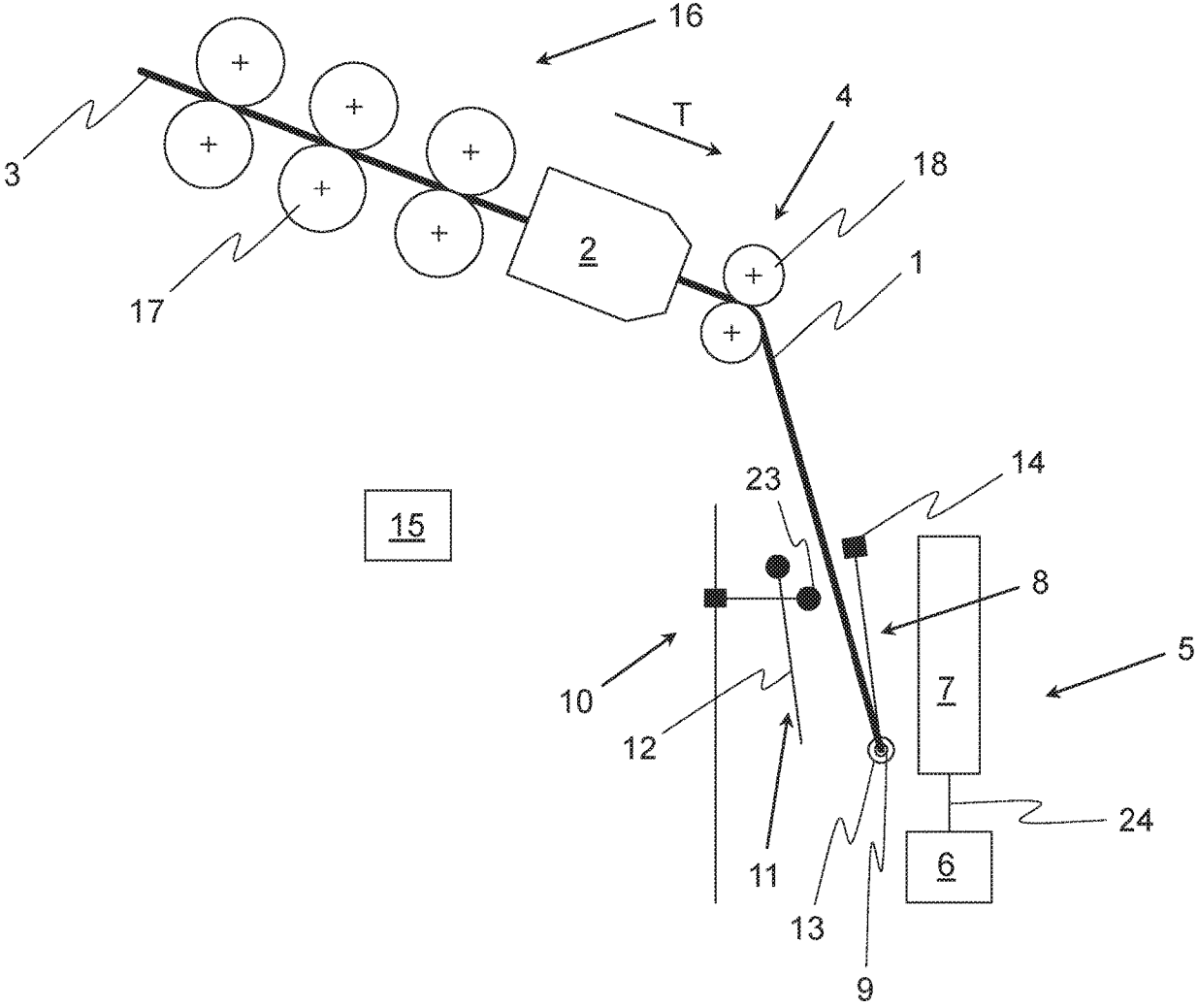
Figure 3:
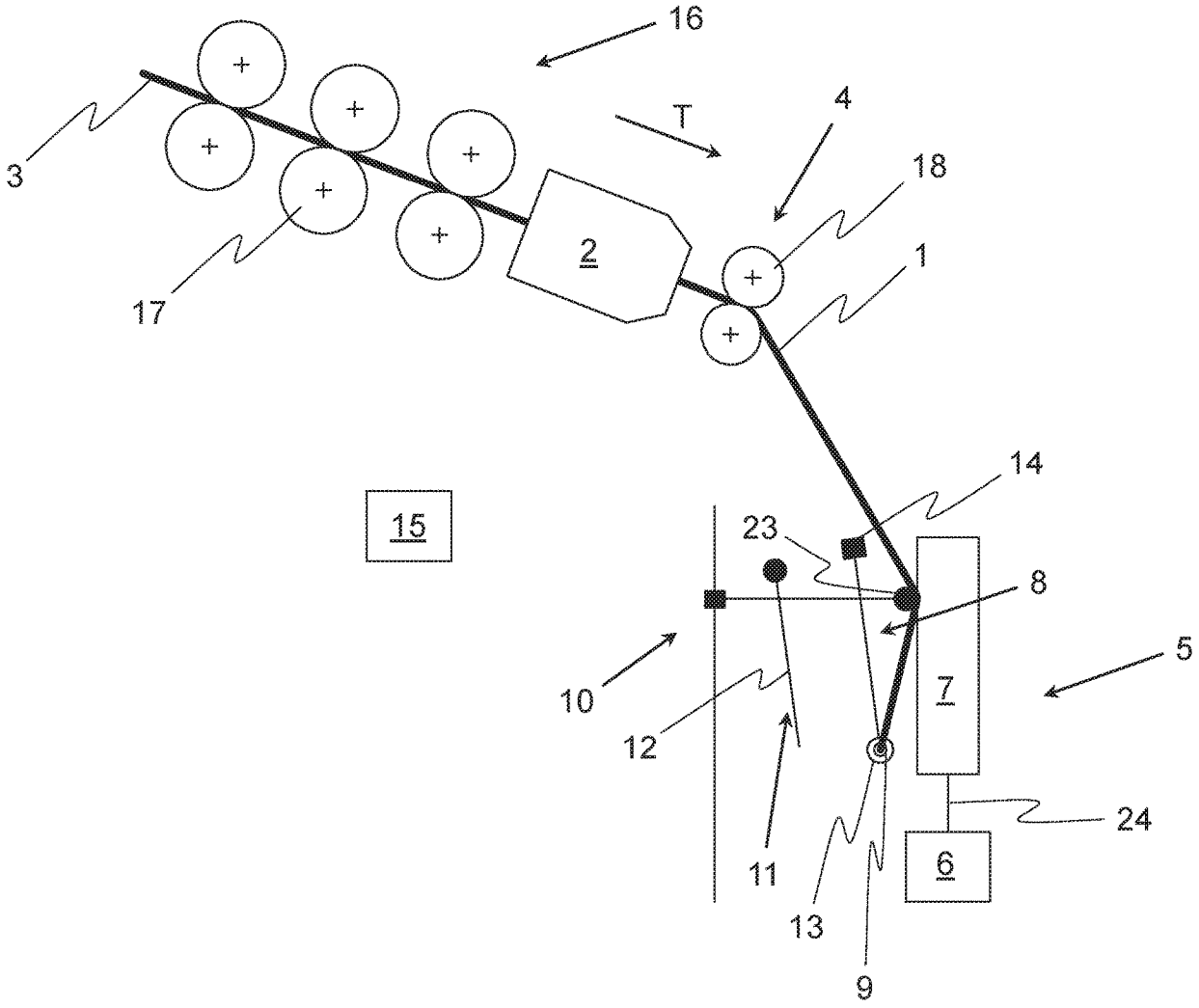

FIGS. 1 to 3 show a schematic view of part of a textile machine according to the invention in the form of an air-jet spinning machine serving as an example of such a textile machine, which serves to produce a roving 1, at different points in time during a start procedure. The air-jet spinning machine may, if necessary, comprise a drafting system 16 comprising a plurality of corresponding drafting system rollers 17 (only one of the drafting system rollers 17 has been provided with a reference sign for clarity reasons), to which there is fed a fiber bundle 3, for example in the form of a doubled-over draw frame sliver. The illustrated air-jet spinning machine also comprises in principle a consolidating means, spaced apart from the drafting system 16, in the form of an air spinning nozzle 2 having an internal vortex chamber (known from the prior art and therefore not shown) and a yarn forming element (likewise known from the prior art and therefore not shown). In the air spinning nozzle 2, the fiber bundle 3 or at least a portion of the fibers of the fiber bundle 3 is provided with a protective twist.

The air-jet spinning machine may also comprise a draw-off unit 4 comprising preferably two draw-off rollers 18 for the roving 1 (the draw-off unit 4 is not absolutely necessary). A winding device 5 arranged downstream of the draw-off unit 4 is also usually present, which winding device in turn should comprise at least one tube drive 6 and in each case a tube holder which is connected to the tube drive 6 and is known in principle, by means of which a tube 7 can be fixed and can be set in a rotational movement by means of the tube drive 6.

The winding device 5 may also comprise two or more two tube holders so that, besides a holder for a tube 7 that is currently being wound during operation of the air-jet spinning machine, one or more further holders for empty tubes 7 may be present. Once the first tube 7 has been wound, a tube change takes place, during which the wound tube 7 is replaced by an empty tube 7, so that the winding process 5 can ultimately be continued without any interruption in roving production.

The air-jet spinning machine shown as an example of a textile machine according to the invention operates according to a special air spinning process. In order to form the roving 1, the fiber bundle 3 is guided in a transport direction T via an inlet opening (not shown) into the vortex chamber of the air spinning nozzle 2. There, it is given a protective twist, that is to say, at least a portion of the fibers of the fiber bundle 3 is grasped by a swirled air flow which is created by suitably placed air nozzles. A portion of the fibers is thereby pulled at least a little way out of the fiber bundle 3 and is wound around the tip of a yarn forming element which protrudes into the vortex chamber.

Finally, the fibers of the fiber bundle 3 are drawn out of the vortex chamber via an inlet mouth of the yarn forming element and a draw-off channel which is arranged inside the yarn forming element and adjoins the inlet mouth. In doing so, the free fiber ends are finally also drawn on a helical trajectory in the direction of the inlet mouth and wrap as wrapping fibers around the centrally running core fibers, resulting in a roving 1 which has the desired protective twist.

Due to the only partial twisting of the fibers, the roving 1 has a draftability which is essential for the further processing of the roving 1 in a downstream spinning machine, for example a ring spinning machine. Conventional air-jet spinning devices, on the other hand, give the fiber bundle 3 such a pronounced twist that the required drafting following yarn production is no longer possible. This is also desired in this case since conventional air-jet spinning machines are designed to produce a finished yarn, which is generally intended to be characterized by a high strength.

Before a tube 7 can be wound with roving 1, a start procedure must take place, during which the roving 1 leaving the air spinning nozzle 2 is brought into contact with the tube 7. Part of a possible start procedure is shown in FIGS. 1 to 3.

Firstly, a fiber bundle 3 is fed into the air spinning nozzle 2 by starting the drafting system 16. The above-described roving production, during which the fiber bundle 3 is given a protective twist, takes place in the air spinning nozzle 2. Finally, the roving 1 leaves the air spinning nozzle 2 via an exit opening (not shown in the figures) and is grasped by the air flow of a suction unit 8. The suction unit 8 preferably has a suction nozzle 13 with a suction opening 9, via which air and thus also the roving 1 leaving the air spinning nozzle 2 can be sucked up or sucked in. In this stage shown in FIG. 1, therefore, the roving 1 produced by the air spinning nozzle 2 leaves the air spinning nozzle 2 and is sucked into the suction unit 8 via the suction opening 9, wherein the delivery speed of the air spinning nozzle 2 preferably corresponds to the delivery speed prevailing after the start procedure or is only slightly lower than the speed.

In general, it should be noted at this point that the entire start procedure preferably takes place without any break in roving production or roving delivery, that is to say, while the drafting system 16 is active, the air spinning nozzle 2 is active and, if present, the draw-off unit 4 is active (that is to say is drawing a roving 1 out of the air spinning nozzle 2), so that a particularly high efficiency of the illustrated air-jet spinning machine can be ensured.

An illustrated controller 15 is also provided, which is operatively connected to the described elements of the air-jet spinning machine in order to carry out, inter alia, the start procedure. The controller 15 may be present for each spinning position of the air-jet spinning machine. It is also conceivable that one controller 15 is responsible for a plurality of spinning positions.

In the next step (see FIG. 2), the suction unit 8 is moved (preferably the suction nozzle 13 is pivoted about a pivot axis 14) into a transfer position in which the suction opening 9 and thus also a section of the roving 1 (which is moreover still being delivered by the air spinning nozzle 2) are located in the region of the tube surface. Contact between the tube 7 and the roving 1 preferably does not yet exist at this stage.

While the suction unit 8 is assuming its position shown in FIG. 2 (or shortly thereafter), the traversing unit 10 is moved into the position shown schematically in FIG. 3, in which the roving 1 is grasped and guided by the traversing unit 10. The traversing unit 10 thereby moves the roving 1 into the vicinity of the tube 7 or brings about direct contact between the tube 7 and the roving 1, so that the roving 1 (preferably under the effect of suitable rough surface sections of the tube 7) is grasped by the tube 7.

At the same time or shortly thereafter, a cutting unit 11 is finally activated, which comprises for example a movable (preferably pivotable) cutting arm 12. The cutting unit 11 is thereby brought into contact with the roving 1, preferably with the section thereof that is located between the traversing unit 10 and the suction opening 9. At this moment, a local decelerating of the roving 1 occurs in the region which comes into contact with the cutting unit 11, so that the roving 1 finally tears between the tube 7 and the cutting unit 11 since it continues to be wound up by the rotating tube 7, that is to say has a tensile force applied to it. Due to the tearing of the roving 1, a section of the roving 1 on the suction unit side is obtained, which can be conveyed away via the suction unit 8. A roving section on the air spinning nozzle side is also obtained, which is already grasped by the tube 7 and extends between the air spinning nozzle 2 and the tube 7.

By virtue of the further rotation of the tube 7, the roving 1 still being delivered by the air spinning nozzle 2 is continuously wound onto the tube 7, wherein the traversing unit 10, by virtue of a movement in the direction of the rotation axis 24 of the tube 7, ensures that the roving 1 is uniformly wound onto the tube 7. At this stage in which the cutting unit 11 and also the suction unit 8 have assumed their original positions, the air-jet spinning machine is finally in its normal mode following the start procedure, in which normal mode the tube 7 is wound with roving 1 until the desired bobbin size is achieved.

According to the present invention, it is now provided that the roving 1 is guided by means of a guide element 23, wherein the guide element 23 is arranged between the air spinning nozzle 2 and the tube 7. Preferably, the guide element 23 is located between the tube 7 and the draw-off unit 4 that is arranged downstream of the air spinning nozzle 2 in the transport direction T, and is for example part of the traversing unit 10. Moreover, the roving 1 is decelerated by means of the guide element 23, that is to say the roving 1 is moved past the guide element 23 or a guide surface thereof in such a way that the friction between the guide element 23 and the roving 1 exerts a decelerating effect on the roving 1.

The reason for the decelerating according to the invention is as follows: If the roving 1 were to be grasped directly by the rotating tube 7 after passing the air spinning nozzle 2 or a possible downstream draw-off unit 4, a tensile force would act on the roving 1 and would lead to the immediate tearing of the roving 1, since the latter has only a low tear resistance in comparison to a conventional yarn.

If, on the other hand, the roving 1 is guided by means of the guide element 23 according to the invention before it is wound onto the tube 7, then the tensile force generated by the rotating tube 7 can be gradually reduced via the guide surface of the guide element 23 that is in contact with the roving 1 and via the associated friction between the roving 1 and the guide surface. In other words, the tensile force acting on the roving 1 is significantly lower between the air spinning nozzle 2 and the guide element 23 than between the guide element 23 and the tube 7. If, moreover, the guide element 23 bears against the tube 7 or the outer layer of the roving 1 that has already been wound thereon, then the roving 1 can take the high tensile force that is generated by the rotating tube 7, without tearing, since the fiber length of the roving 1 is generally longer than the spacing between the guide element 23 and the tube 7 or the outer roving layer.

As a result, the roving 1 can ultimately be wound onto the tube 7 with a relatively high tension, without risk of tearing of the roving.

Figure 4:
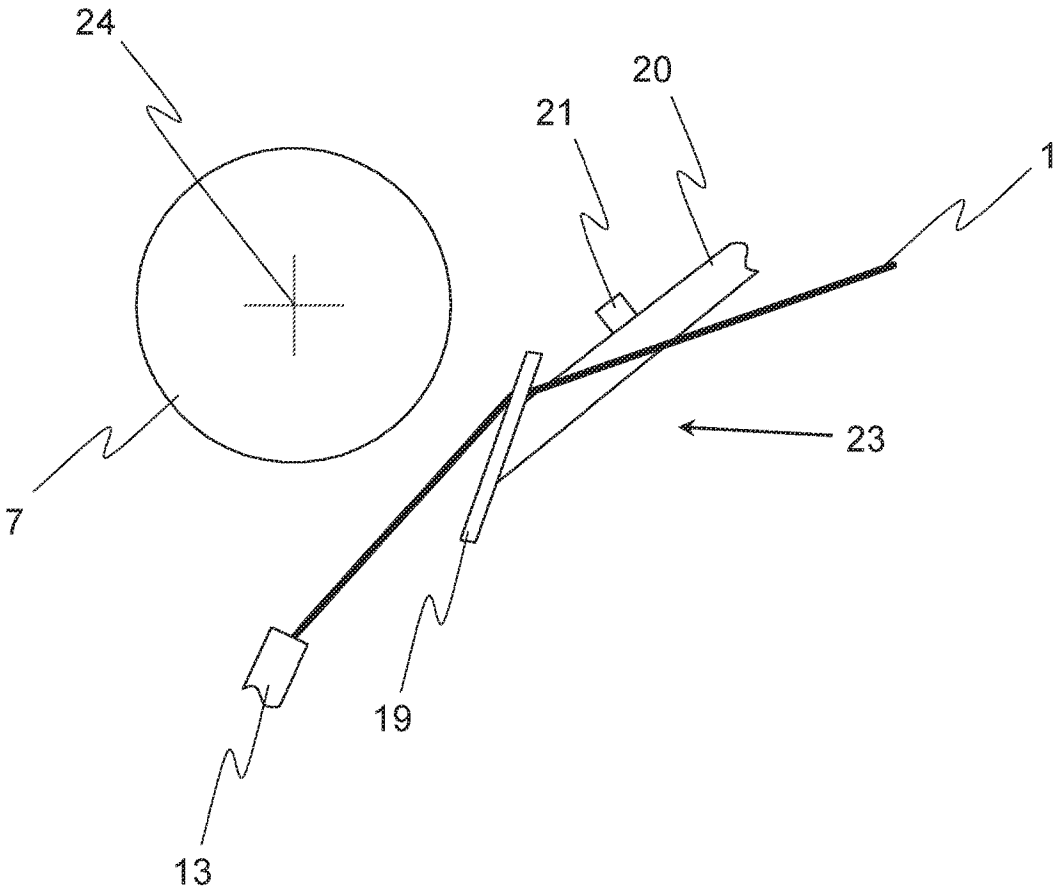
FIG. 4 shows a plan view of part of a textile machine in the form of an air-jet spinning machine.
Figure 5:
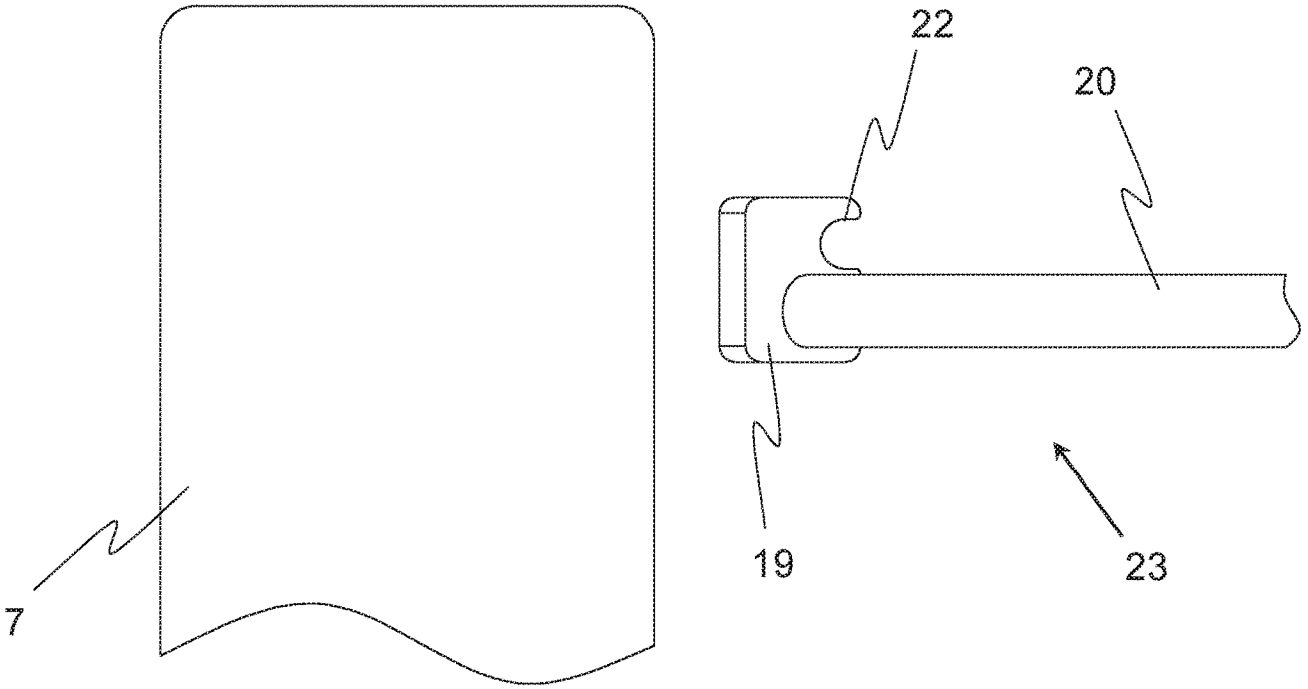
FIG. 5 shows a side view of part of a textile machine in the form of an air-jet spinning machine.

One possible embodiment of the guide element 23 is shown firstly in FIGS. 4 and 5. For instance, it is conceivable that the traversing unit 10 comprises a traversing arm which can be moved back and forth parallel to the rotation axis 24 of the tube(s) 7 located in the winding device 5 and which at the same time represents the guide element 23. The guide element 23 preferably has a wrapping section 20, which is rod-shaped for example, and a front guide section 19 for the roving 1.

FIG. 4 shows one possible course of the roving 1 coming from the air spinning nozzle 2 during the start procedure, which roving is still being sucked up by the suction unit 8 at this point in time. The roving 1 is guided in a guide groove 22 of the guide section 19 (cf. FIGS. 5 and 7) and wraps slightly around the wrapping section 20 so that only a low decelerating force acts on the roving 1. The fact that the decelerating effect is not too high is critical at this stage since the low tensile force brought about by the air flow of the suction unit 8, given too high a decelerating effect, would not be sufficient to draw the roving 1 over the guide surface of the guide element 23 (the guide surface is moreover that surface of the guide element 23 which is in each case directly in contact with the roving 1).

Before the guide element 23 is pivoted in the direction of the tube 7, it may be advantageous to increase the decelerating effect, wherein this may take place for example by rotating a gripper 21. In so doing, the roving 1 is grasped and is wrapped further around the wrapping section 20. Such a "screwing-in" can be seen from a comparison of FIGS. 4 and 6 (which likewise shows that only the gripper 21 has moved, but not the guide section 19; to this end, a rotational decoupling (not shown) is provided between the gripper 21 and the wrapping section 20 or the guide section 19, so that the gripper 21 can be moved, preferably rotated, relative to the guide section 19 or to the wrapping section 20).

Figure 6:
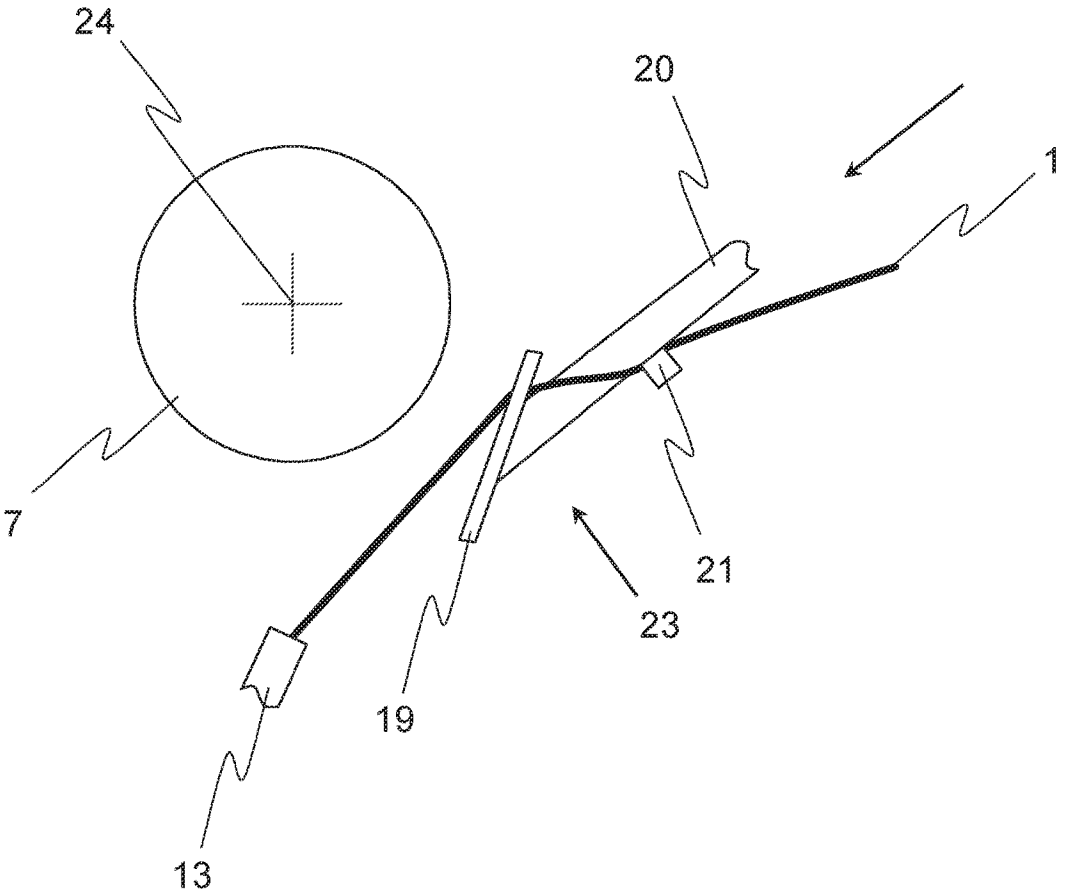
FIG. 6 shows the view of FIG. 4 with a changed wrapping angle.
Figure 7:
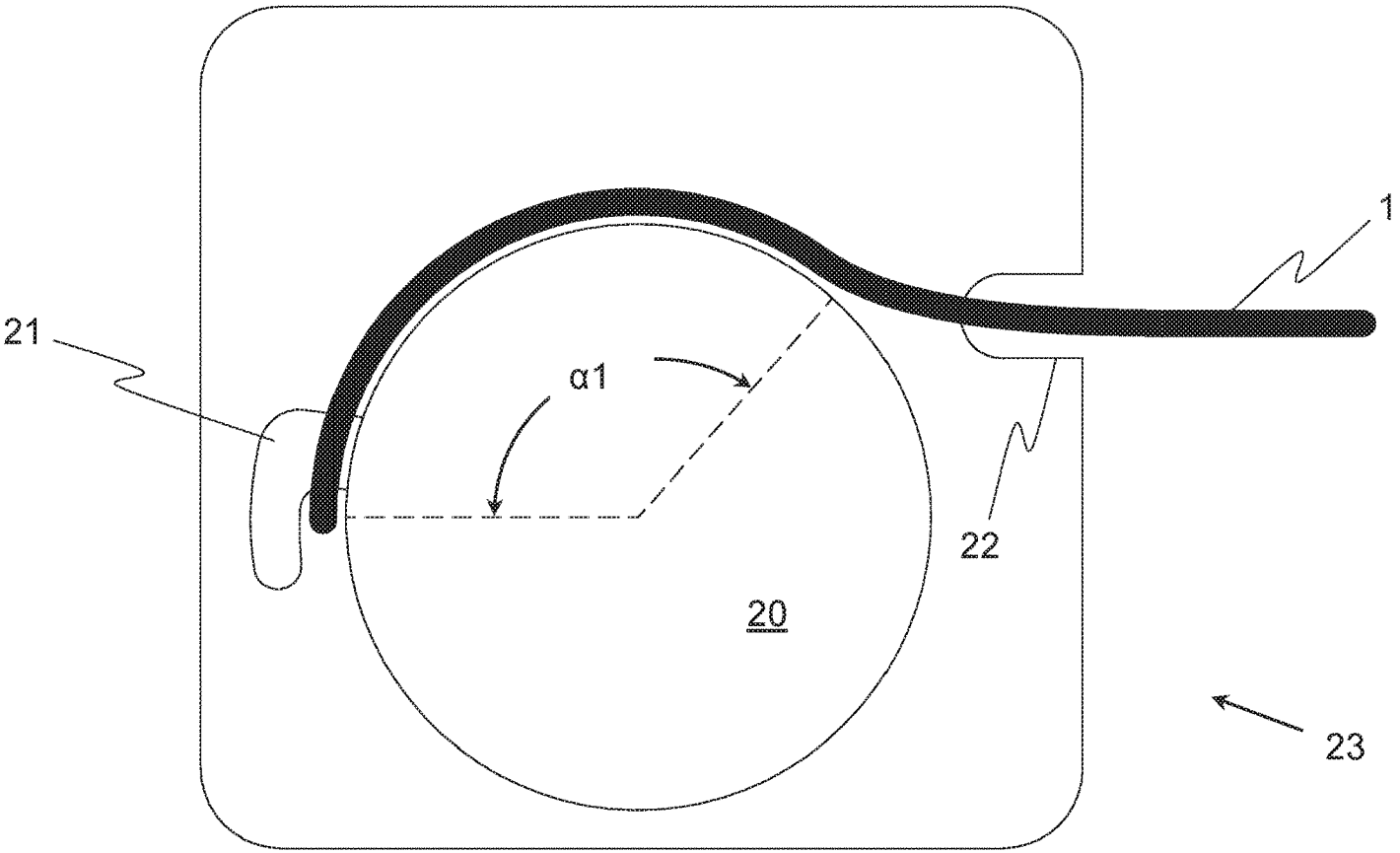
FIG. 7 shows a rear view of a guide element of a textile machine in the form of an air-jet spinning machine.

FIG. 7 shows a view as seen in the direction of the arrow shown in FIG. 6. As can be seen from said FIG. 7, the decelerating effect exerted on the roving 1 by the guide element 23 is brought about on the one hand by the wrapping of the wrapping section 20. On the other hand, however, the decelerating effect is also increased by the wrapping of the gripper 21, since only the wrapping angle of a surface, but not the radius of curvature thereof, determines the extent of the friction force acting on the roving 1. The total wrapping angle $\alpha$ is therefore composed of the wrapping angle $\alpha 1$ shown in FIG. 7 and the wrapping angle in the region of the gripper 21 (and possibly further wrapping angles of additional wrapped surface sections of the guide element 23). The actual wrapping angle $\alpha$ in FIG. 7 is therefore higher than the denoted angle $\alpha 1$.

Figure 8:
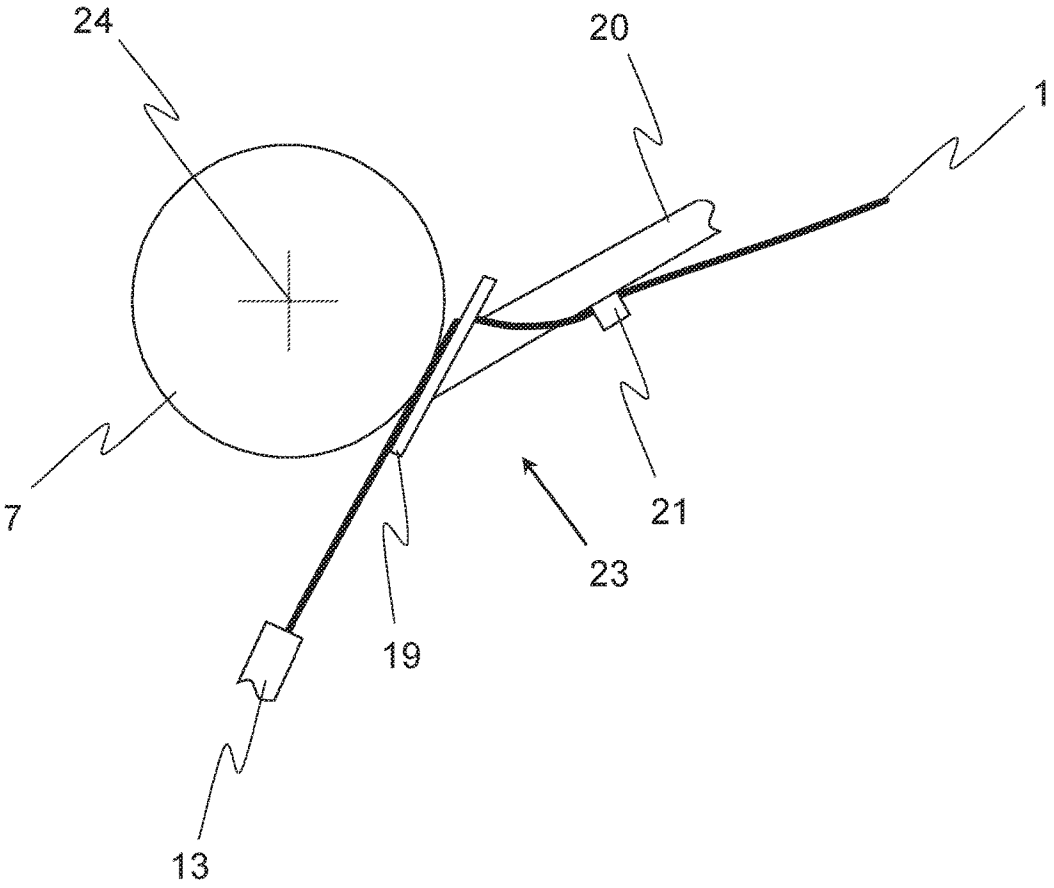
FIGS. 8 to 10 show the view of FIG. 4 with in each case a changed wrapping angle and a changed position of the guide element.
Figure 9:
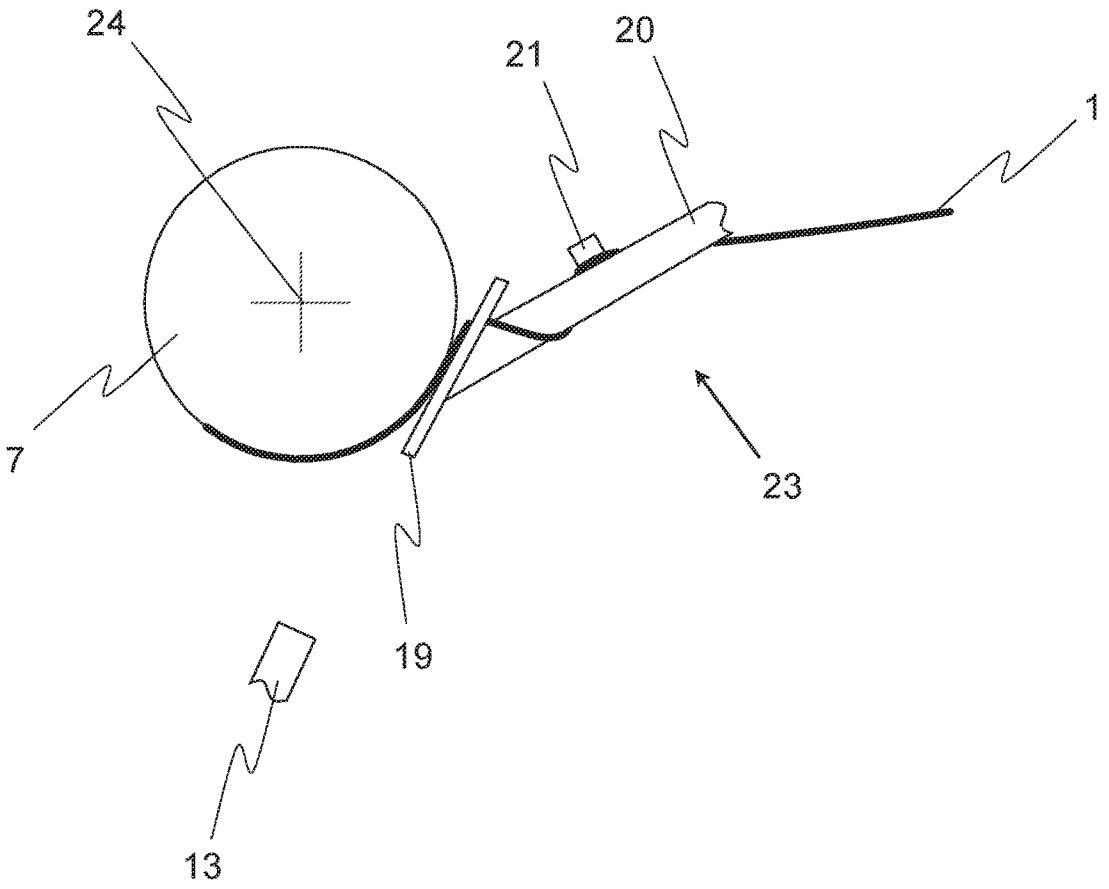

FIG. 8 shows the stage in which the guide element 23 bears against the tube 7 and thus the roving 1 is brought into contact with the tube 7, as illustrated in FIG. 3 (as already mentioned, the guide element 23 is preferably part of the traversing unit 10 shown schematically in FIGS. 1 to 3). Following the contact between the tube 7 and the roving 1, the roving 1 is finally cut between the tube 7 and the suction nozzle 13. To this end, the air-jet spinning machine comprises for example a cutting unit 11 shown in FIGS. 1 to 3, having a cutting arm 12 which is mounted in a movable, preferably pivotable, manner. The cutting arm is pivoted into the course of the roving 1 and finally brings about a cutting of the roving 1 between the suction nozzle 13 and the tube 7. While one part of the roving 1 is sucked up by the suction nozzle 13, the other part coming from the air spinning nozzle 2 is wound onto the tube 7. FIG. 9 shows the start of the winding process, wherein the wrapping angle $\alpha$ and thus also the decelerating effect on the roving 1 have been further increased in comparison to FIG. 8, wherein this has been achieved by a further rotation of the gripper 21.

Figure 10:
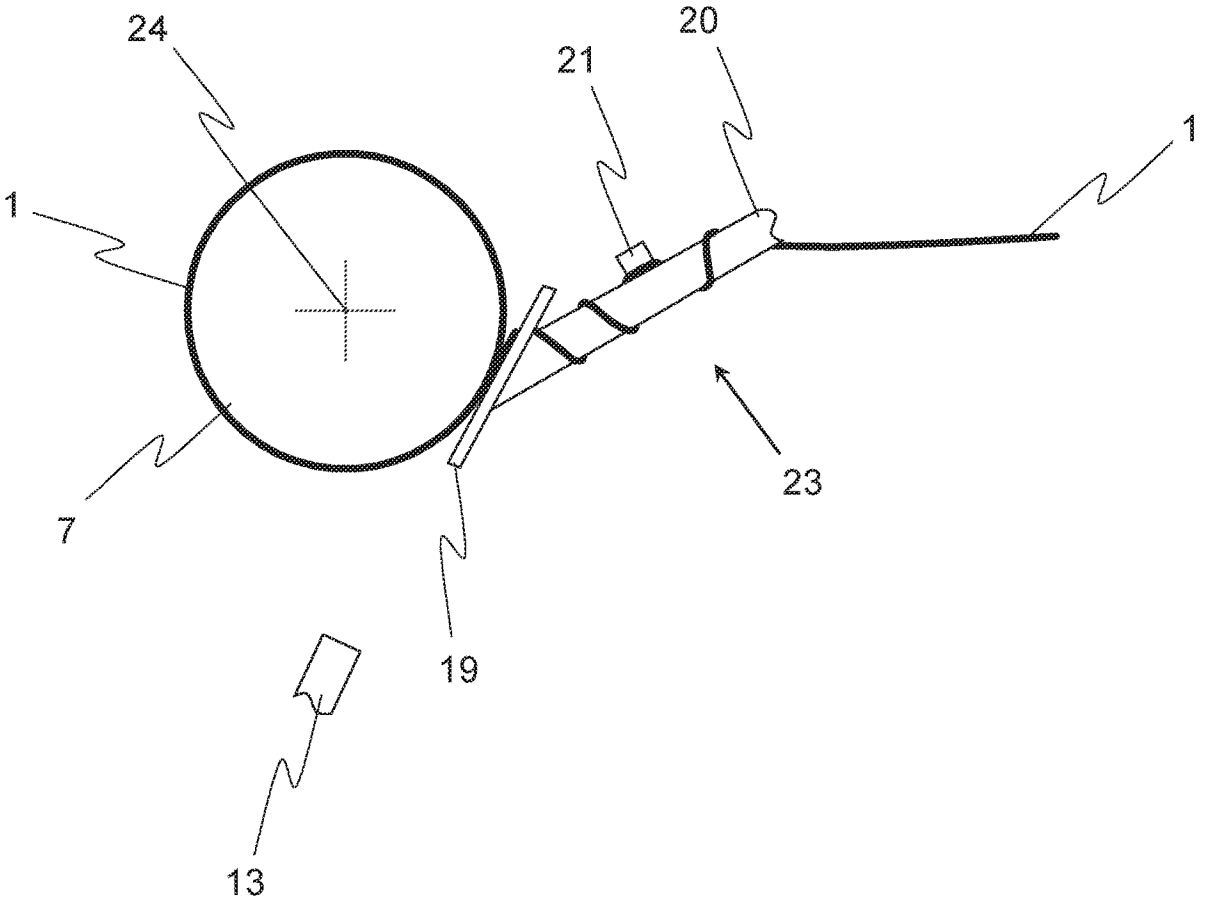

While the tube 7 continues to receive roving 1, the decelerating effect is finally increased to a final value which is maintained until the start of a following tube change so as to be able to wind the roving 1 onto the tube 7 under increased tension (see FIG. 10).

Once a predefined degree of filling of the tube 7 has been reached, the decelerating effect is reduced again by reducing the wrapping angle $\alpha$, and the wound tube 7 is replaced by an empty tube 7 without interrupting the roving production. Once the roving 1 has entered into contact with the empty tube 7, the decelerating effect can be increased again by increasing the wrapping angle $\alpha$, until a new tube change is pending.

The present invention is not limited to the exemplary embodiments that have been shown and described. Modifications within the scope of the claims are also possible, as is any combination of the described features, even if they are shown and described in different parts of the description or the claims or in different exemplary embodiments.

LIST OF REFERENCE SIGNS

1 roving
2 air spinning nozzle
3 fiber bundle
4 draw-off unit
5 winding device
6 tube drive
7 tube
8 suction unit
9 suction opening
10 traversing unit
11 cutting unit
12 cutting arm
13 suction nozzle
14 rotation axle of the suction nozzle
15 controller
16 drafting system
17 drafting system roller
18 draw-off roller
19 guide section
20 wrapping section
21 gripper
22 guide groove
23 guide element
24 rotation axle of the tube
T transport direction
$\alpha$ wrapping angle

The invention claimed is:

1. A method for operating a textile machine to produce roving, comprising:

during roving production, producing a roving from a fiber bundle with a consolidating means, the roving having a protective twist;

winding the produced roving with a winding device onto a tube;

during the winding process, guiding the roving with a guide element arranged between the consolidating means and the tube, wherein the guide element exerts a decelerating effect on the roving;

wherein the decelerating effect is controlled during operation of the textile machine such that the decelerating effect is lower during a start procedure while the roving leaving the consolidating means is brought into contact with a tube or during a tube change while a wound tube is replaced by an empty tube than during a winding process that takes place between the start procedure and the tube change.

2. The method according to claim 1, wherein the consolidating means is air spinning nozzle, wherein the roving having the protective twist is produced from the fiber bundle within the air spinning nozzle by means of a swirled air flow.

3. The method according to claim 1, wherein the decelerating effect is varied by decreasing or increasing a size of a contact area of the guide element over which the roving is in contact.

4. The method according to claim 3, wherein the roving is wrapped around the guide element over a wrapping angle (a), the decelerating effect varied by varying the wrapping angle (a) by winding or unwinding the roving on the guide element.

5. The method according to claim 4, wherein the wrapping angle ($\alpha$) during the winding process is at least temporarily between 400° and 2000°.

6. The method according to claim 4, wherein the wrapping angle (a) during the start procedure or the tube change is at least temporarily between 50° and 1000°.

7. The method according to claim 1, wherein the decelerating effect causes a tension that acts on the section of the roving that is in contact with the guide element, the decelerating effect controlled such that an average magnitude of the tension during the winding process is at least two times higher than during the start procedure or during the tube change.

8. The method according to claim 1, wherein the decelerating effect is increased at the latest 10 seconds after the roving during the start procedure or during the tube change comes into contact with an empty tube.

9. The method according to claim 1, wherein the decelerating effect is increased while a 1st to 600th winding of the roving is being wound onto an empty tube.

10. The method according to claim 1, wherein the decelerating effect is reduced during the winding process at least 0.01 seconds prior to start of a pending tube change.

11. The method according to claim 1, wherein during the winding process, the roving is traversed between defined turning points by the guide element.

12. The method according to claim 1, wherein during the tube change the roving being produced by the consolidating means continues to be wound onto the tube until the roving comes into contact with an empty tube for the tube change.

13. The method according to claim 12, wherein the roving is guided continuously by the guide element during the tube change.

14. A textile machine for producing a roving, comprising:

a consolidating means for producing a roving from a fiber bundle, the roving having a protective twist;

a winding device configured to wind the produced roving onto a tube; and a controller that operates the textile machine such that the roving is produced in accordance with the method of claim 1.

15. The textile machine according to claim 14, wherein the consolidating means comprises an air spinning nozzle, wherein the roving having the protective twist is produced from the fiber bundle within the air spinning nozzle by means of a swirled air flow.

* * * * *